US006924776B2

(12) United States Patent
Le et al.

(10) Patent No.: US 6,924,776 B2
(45) Date of Patent: Aug. 2, 2005

(54) WIDEBAND DUAL POLARIZED BASE STATION ANTENNA OFFERING OPTIMIZED HORIZONTAL BEAM RADIATION PATTERNS AND VARIABLE VERTICAL BEAM TILT

(75) Inventors: Kevin Le, Arlington, TX (US); Louis J. Meyer, Shady Shores, TX (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/737,214

(22) Filed: Dec. 16, 2003

(65) Prior Publication Data

US 2005/0001778 A1 Jan. 6, 2005

Related U.S. Application Data

(60) Provisional application No. 60/484,688, filed on Jul. 3, 2003.

(51) Int. Cl.[7] ..... H01Q 11/10

(52) U.S. Cl. ..... 343/792.5; 343/810; 343/818; 343/797; 343/846

(58) Field of Search ..... 343/810–820, 343/795, 797, 792.5, 853, 846

(56) References Cited

U.S. PATENT DOCUMENTS

| | | | | |
|---|---|---|---|---|
| 3,286,268 A | | 11/1966 | Barbano | 343/792.5 |
| 3,396,399 A | | 8/1968 | Winegard | 343/811 |
| 3,482,250 A | | 12/1969 | Maner | 343/766 |
| 3,490,026 A | | 1/1970 | Kolbe et al. | 343/819 |
| 5,165,109 A | | 11/1992 | Han et al. | 343/700 MS |
| 5,440,318 A | | 8/1995 | Butland et al. | 343/814 |
| 5,629,713 A | | 5/1997 | Mailandt et al. | 343/808 |
| 5,771,024 A | | 6/1998 | Reece et al. | 343/725 |
| 5,798,675 A | | 8/1998 | Drach | 343/850 |
| 5,917,455 A | | 6/1999 | Huynh et al. | 343/792.5 |
| 5,952,983 A | | 9/1999 | Dearnley et al. | 343/817 |
| 5,966,102 A | | 10/1999 | Runyon | 343/820 |
| 6,034,649 A | | 3/2000 | Wilson et al. | 343/795 |
| 6,072,439 A | * | 6/2000 | Ippolito et al. | 343/797 |
| 6,243,050 B1 | * | 6/2001 | Powell | 343/792.5 |
| 6,310,585 B1 | | 10/2001 | Marino | 343/818 |
| 6,535,168 B1 | | 3/2003 | Marumoto et al. | 343/700 MS |
| 6,573,875 B2 | | 6/2003 | Zimmerman et al. | 343/853 |
| 6,597,324 B2 | | 7/2003 | Eriksson | 343/795 |
| 6,603,436 B2 | | 8/2003 | Heinz et al. | 343/757 |
| 6,646,611 B2 | | 11/2003 | Plet et al. | 343/702 |
| 6,667,714 B1 | | 12/2003 | Solondz | 342/368 |
| 6,819,300 B2 | * | 11/2004 | Gottl | 343/795 |
| 2002/0135524 A1 | | 9/2002 | Zimmerman et al. | 343/760 |

* cited by examiner

*Primary Examiner*—Shih-Chao Chen
*Assistant Examiner*—Ephrem Alemu
(74) *Attorney, Agent, or Firm*—Jackson Walker LLP; Robert C. Klinger

(57) ABSTRACT

A dual polarized variable beam tilt antenna (10) having a plurality of offset element trays (12) each supporting pairs of dipole elements (14) to orient the dipole element pattern boresight at a downtilt. The maximum squint level of the antenna is a consistent downtilt off of boresight and which is at the midpoint of the antenna tilt range. The antenna provides a high roll-off radiation pattern through the use of Yagi dipole elements configured in this arrangement, having a beam front-to-side ratio exceeding 20 dB, a horizontal beam front-to-back ratio exceeding 40 dB, and is operable over an expanded frequency range.

22 Claims, 7 Drawing Sheets

WIDEBAND DUAL POLARIZED BASE STATION ANTENNA OFFERING OPTIMIZED HORIZONTAL BEAM RADIATION PATTERNS AND VARIABLE VERTICAL BEAM TILT

CLAIM OF PRIORITY

This application claims priority of U.S. Provision patent application Ser. No. 60/484,688 entitled "Balun Antenna With Beam Director" filed Jul. 3, 2003, the teaching of which are incorporated herein by reference.

FIELD OF THE INVENTION

The present invention is related to the field of antennas, and more particularly to dual polarized base station antennas for wireless communication systems.

BACKGROUND OF THE INVENTION

Wireless mobile communication networks continue to be deployed and improved upon given the increased traffic demands on the networks, the expanded coverage areas for service and the new systems being deployed. Cellular type communication systems derive their name in that a plurality of antenna systems, each serving a sector or area commonly referred to as a cell, are implemented to effect coverage for a larger service area. The collective cells make up the total service area for a particular wireless communication network.

Serving each cell is an antenna array and associated switches connecting the cell into the overall communication network. Typically, the antenna array is divided into sectors, where each antenna serves a respective sector. For instance, three antennas of an antenna system may serve three sectors, each having a range of coverage of about 120°. These antennas are typically vertically polarized and have some degree of downtilt such that the radiation pattern of the antenna is directed slightly downwardly towards the mobile handsets used by the customers. This desired downtilt is often a function of terrain and other geographical features. However, the optimum value of downtilt is not always predictable prior to actual installation and testing. Thus, there is always the need for custom setting of each antenna downtilt upon installation of the actual antenna. Typically, high capacity cellular type systems can require re-optimization during a 24 hour period. In addition, customers want antennas with the highest gain for a given size and with very little intermodulation (IM). Thus, the customer can dictate which antenna is best for a given network implementation.

It is a principal objective of the present invention to provide a dual polarized antenna array having optimized horizontal plane radiation patterns. Specifically, the present invention is designed to radiate in a manner which maximizes horizontal beam front-to-side ratio (20 dB minimum), and also maximizes horizontal beam front-to-back ratio (40 dB typical).

It is a further objective of the invention to provide a dual polarized antenna array capable of operating over an expanded frequency range (23 percent bandwidth).

It is a further objective of the invention to provide a dual polarized antenna array capable of producing adjustable vertical plane radiation patterns.

It is another objective of the invention to provide an antenna with enhanced port to port isolation (30 dB minimum).

It is another objective of the invention to provide an antenna array with optimized cross polarization performance (minimum of 10 dB co-pol to cross-pol ratio in 120 deg. horizontal sector).

It is another objective of the invention to provide an antenna array with a horizontal pattern beamwidth of 59° to 72°.

It is a further object of the invention to provide a dual polarized antenna with high gain.

It is another objective of the invention to provide an antenna array with minimized intermodulation.

It is another objective of this invention to provide an antenna array with an optimized aerodynamic shape to reduce wind load effect and reduce radiation pattern distortion.

It is further object of the invention to provide inexpensive antenna.

These and other objectives of the invention are provided by an improved antenna array for transmitting and receiving electromagnetic waves with +45° and −45° linear polarizations.

SUMMARY OF THE INVENTION

The present invention achieves technical advantages as a variable beam tilt dual polarized antenna having an optimized horizontal beam radiation pattern.

The antenna array design consists of a sophisticated multi-layered ground plane structure, dual polarized Yagi radiating elements, and a hybrid feed network comprised of printed circuit board (PCB) microstrip phase shifters, coaxial cable transmission lines, and air dielectric microstrip (airstrip) transmission lines.

The multi-layered ground plane structure dramatically improves the horizontal plane radiation patterns. Structural features provide increased horizontal pattern front-to-back ratio, and which also reduce horizontal pattern beam squint. Specifically, the ground plane structure is composed of individual substructures that are fastened together to form a specific geometry. The substructures are preferably fabricated from either aluminum alloy, or brass alloy. Aluminum is the preferred alloy due to its high strength to weight ratio, and low cost, while brass alloy is specified in applications where electrical connections are created by soldering process. Tray supports orient the element pattern boresight at 4 degree downtilt, which is the midpoint of the array tilt range. The maximum squint level is consistent with 4 degrees downtilt off of boresight, instead of 8 degrees off of boresight. Maximum horizontal beam squint levels have been reduced to 5 degrees, which is very acceptable considering the array's operating bandwidth and tilt range.

DETAILED DESCRIPTION OF THE PREFERRED EMBODIMENT

Figure 1:
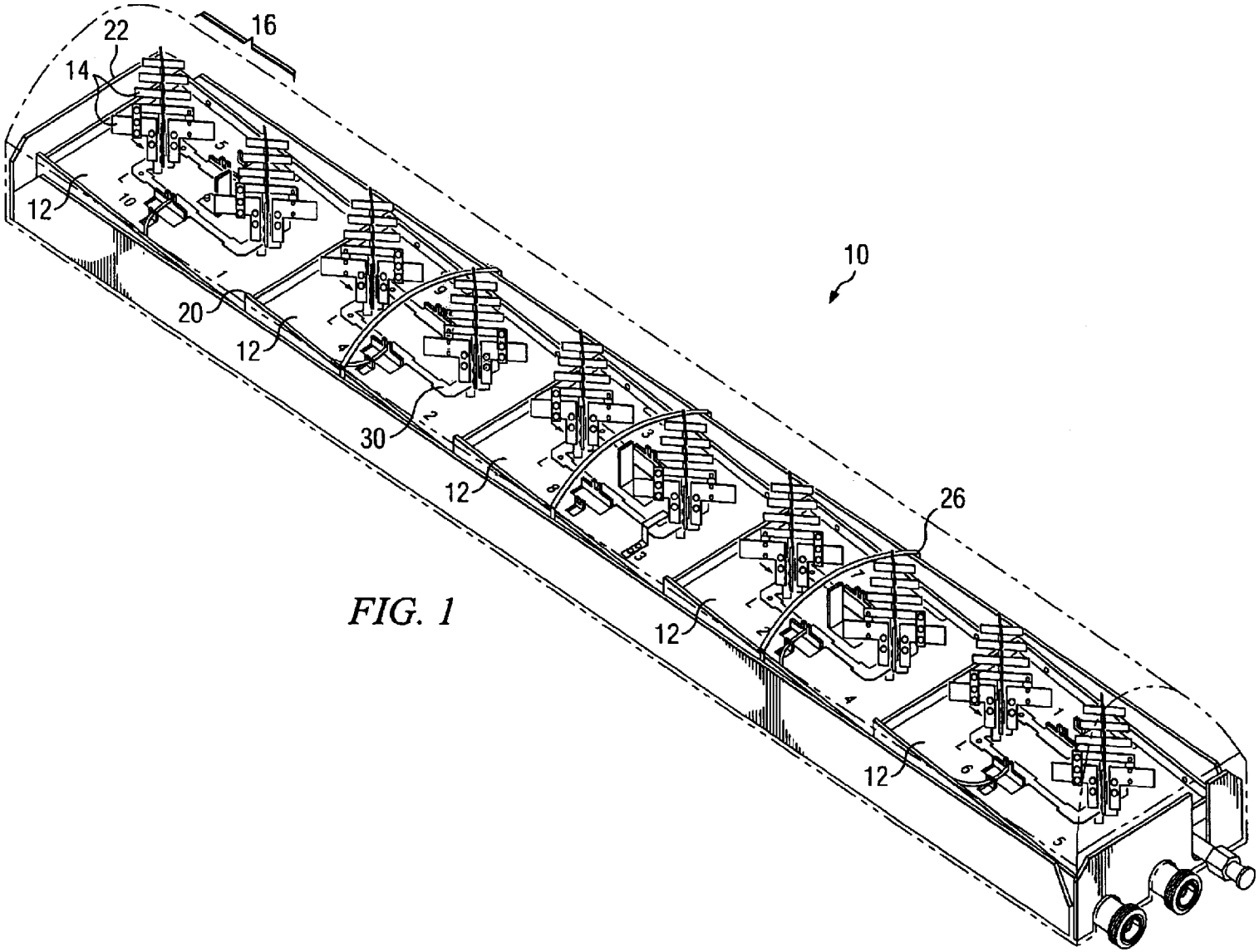
FIG. 1 is a perspective view of a dual polarized antenna having a multi-layered groundplane structure according to a first preferred embodiment of the present invention.
Figure 2:
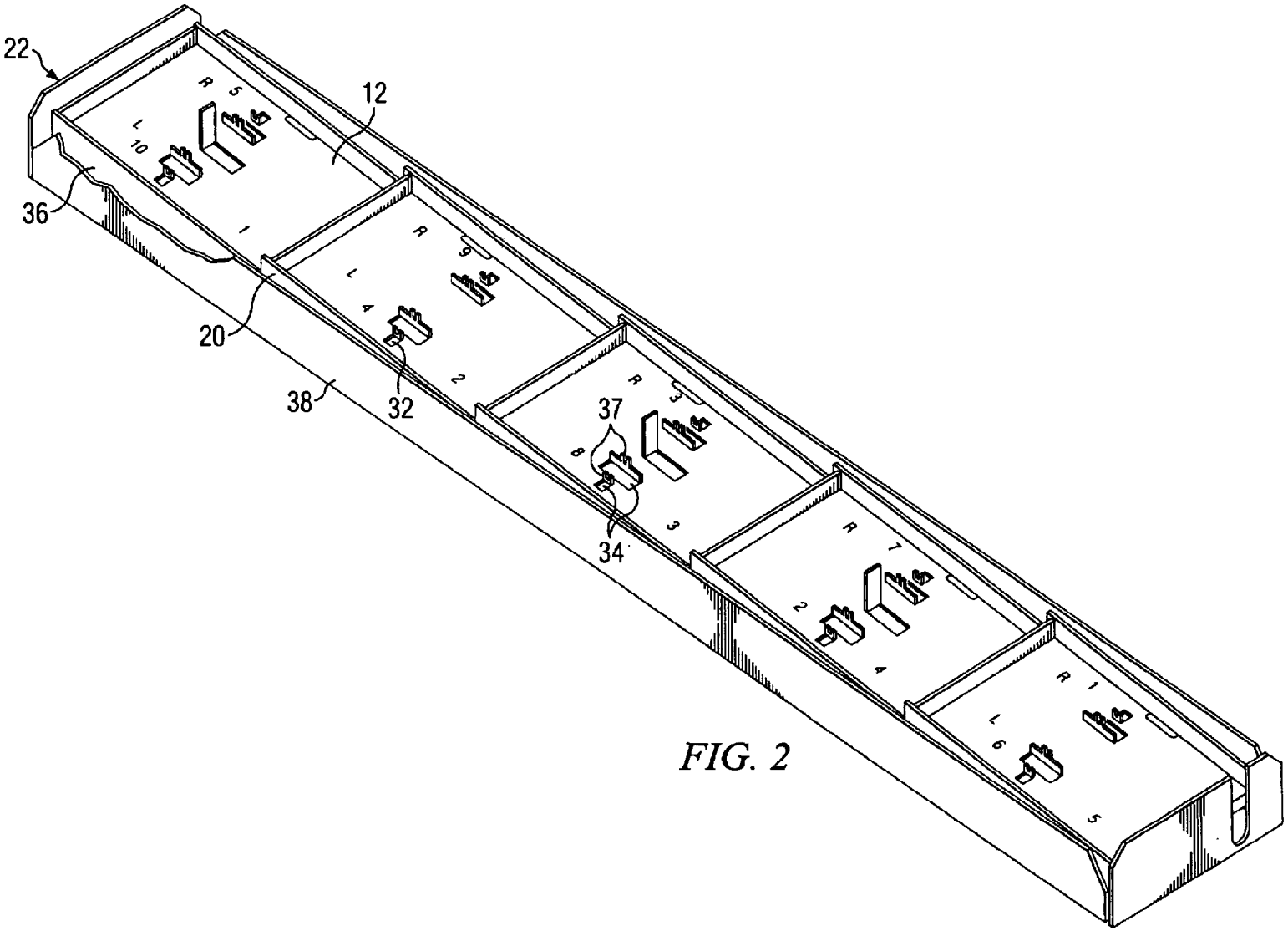
FIG. 2 is a perspective view of the multi-layered groundplane structure with the dipole elements removed therefrom, and the tray element supports the tray cutaway to illustrate the staircasing of the groundplanes.

Referring now to FIG. 1, there is generally shown at 10 a wideband dual polarized base station antenna having an optimized horizontal radiation pattern and also having a variable vertical beam tilt. Antenna 10 is seen to include a plurality of element trays 12 having disposed thereon Yagi dipole antennas 14 arranged in dipole pairs 16. Each of the element trays 12 are arranged in a staircase pattern and supported by a pair of tray supports 20. The integrated element trays 12 and tray supports 20 are secured upon and within an external tray 22 such that there is a gap laterally defined between the tray supports 20 and the sidewalls of tray 22, as shown in FIG. 1 and FIG. 2. Each tray element 12 has an upper surface defining a groundplane for the respective dipole pair 16, and has a respective air dielectric feed network 30 spaced thereabove and feeding each of the dipoles 14 of pairs 16, as shown. A plurality of electrically conductive arched straps 26 are secured between the sidewalls of tray 22 to provide both rigidity of the antenna 10, and also to improve isolation between dipoles 14.

Referring now to FIG. 2, there is shown a perspective view of the element trays 12 with the sidewall of one tray support 20 and tray 22 partially cutaway to reveal the staircasing of tray elements 12. Each tray element 12 is arranged in a staircase design so as to orient the dipole element 14 pattern boresight at a 4° downtilt, which is the midpoint of the array adjustable tilt range. The maximum squint level of antenna 10 is consistent with 4° downtilt off of boresight, instead of 8° off of boresight. According to the present invention, maximum horizontal beam squint levels have been reduced to 5° over conventional approaches, which is very acceptable considering the array's operating wide bandwidth and tilt range.

As shown, a pair of integral divider supports 37 extending above tray element 12. Dividers 32 (shown in FIG. 2) have a beak extending upwardly through a respective opening 34 defined in element tray 12, and provide strong mechanical connection from cable to air dielectric micro stripline 16 and to microstrip feed network defined on a printed circuit board 50 adhered therebelow, as will be discussed in more detail shortly with reference to FIG. 4.

Still referring to FIG. 2, there is illustrated that the tray supports 20 are separated from the respective adjacent sidewalls of tray 22 by a gap 36 defined therebetween. This cavity 36 advantageously reduces the RF current that flows on the backside of the external tray 22. The reduction of induced currents on the backside of the external tray 22 directly reduces radiation in the rear direction. The critical design criteria involved in maximizing the radiation front-to-back ratio includes the height of the folded up lips 38 of external tray 22, the height of the tray supports 20, and the gap 36 between the tray supports 20 and the sidewall lips 38 of tray 22.

Preferably, the element trays 12 are fabricated from brass alloy and are treated with a tin plating finish for solderability. The primary function of the element trays is to support the radiating Yagi elements 14 in a specific orientation, as shown. This orientation provides balanced vertical and horizontal beam patterns for both ports of the antenna 10. This orientation also provides maximum isolation between each port. Additionally, the element trays 12 provide an RF grounding point at the coaxial cable/airstrip interface.

The tray supports are preferably fabricated from aluminum alloy. The primary function of the tray supports is to support the five element trays 12 in a specific orientation that minimizes horizontal pattern beam squint.

The external tray 22 is preferably fabricated from a thicker stock of aluminum alloy, and is treated with an alodine coating to prevent corrosion due to external environment conditions. The primary functions of the external tray 22 is to support the internal array components. A secondary function is to focus the radiated RF power toward the forward sector of the antenna 10 by minimizing radiation toward the back, thereby maximizing the radiation pattern front-to-back ratio, as already discussed.

Figure 3:
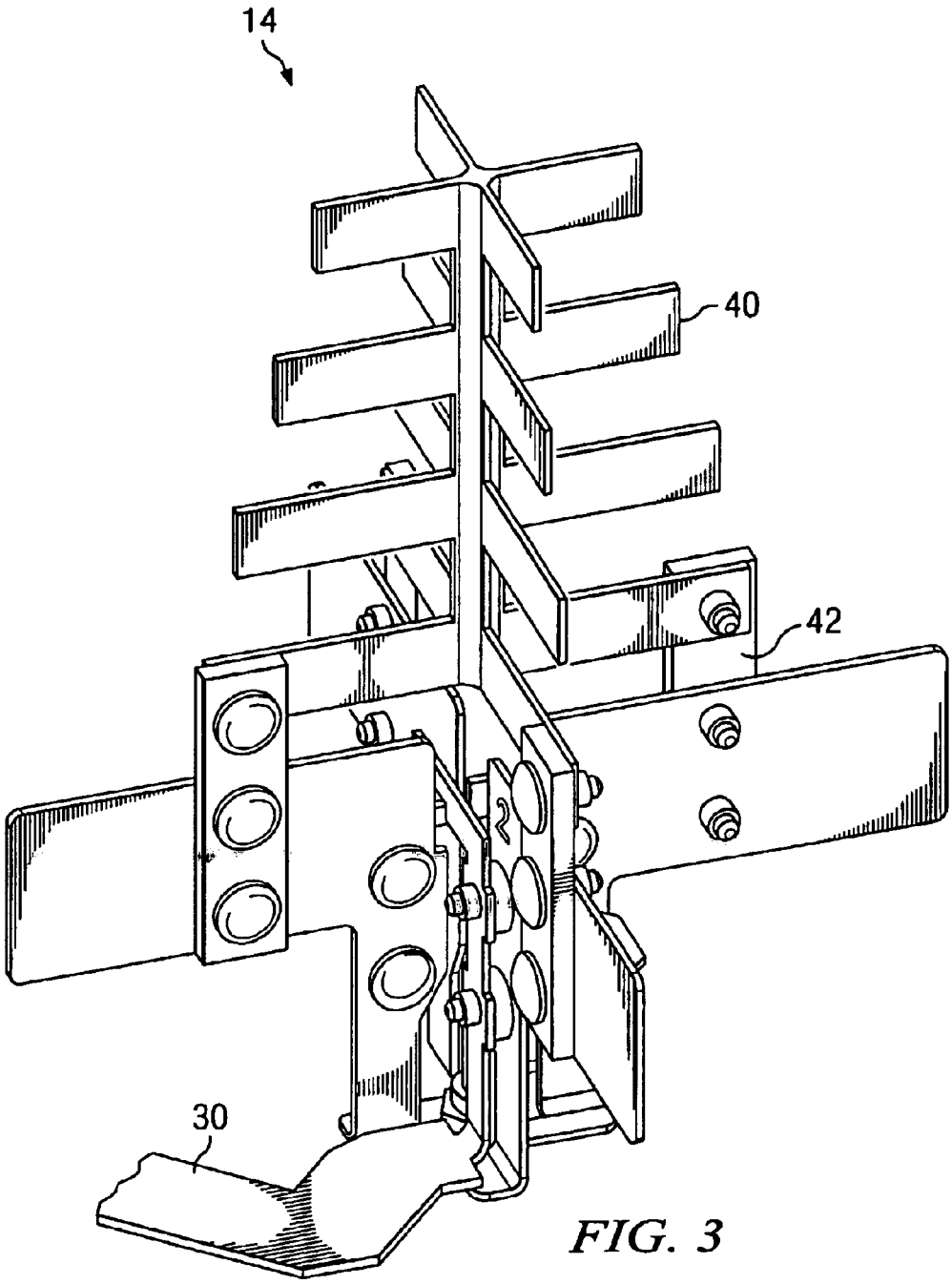
FIG. 3 is a perspective view of one dipole element having Yagi elements.
Figure 5:
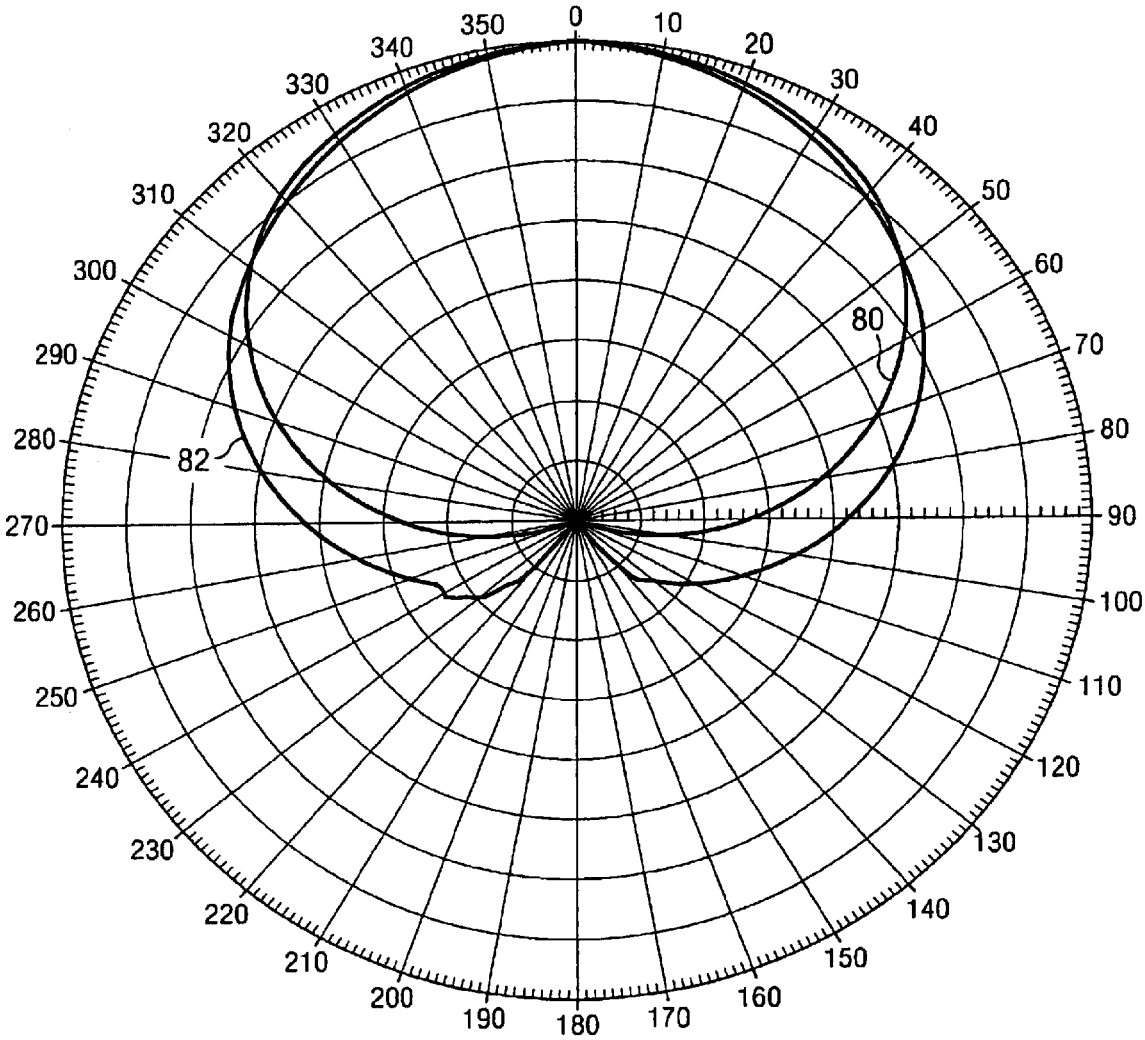
FIG. 5 is a graph depicting the high roll-off radiation pattern achieved by the present invention, as compared to a typical dipole radiation pattern.

Referring now to FIG. 3 there is depicted one dipole antenna 14 having vertically extending Yagi elements 40 and fed by the airstrip feed network 30, as shown. The upwardly extending Yagi elements 40 are uniformly spaced from one another, with the upper portions having a shorter length, as shown. The design of the dipole 14 provides dramatic improvements in the array's horizontal beam radiation pattern. Conventionally, dipole radiating elements produce a horizontal beam radiation pattern with a 15 dB front-to-side ratio. According to the present invention, a broadband parasitic structure 42 is integrated on the dipole 14, and advantageously improves front-to-side ratio by between 5 and 10 dB. This effect is referred to as a "high roll-off" design, as illustrated in FIG. 5. Many other system level performance benefits are afforded by incorporation of this high roll-off antenna design, including improved range due to higher aperture gain, and increased capacity due to increased sector-to-sector rejection.

Figure 4:
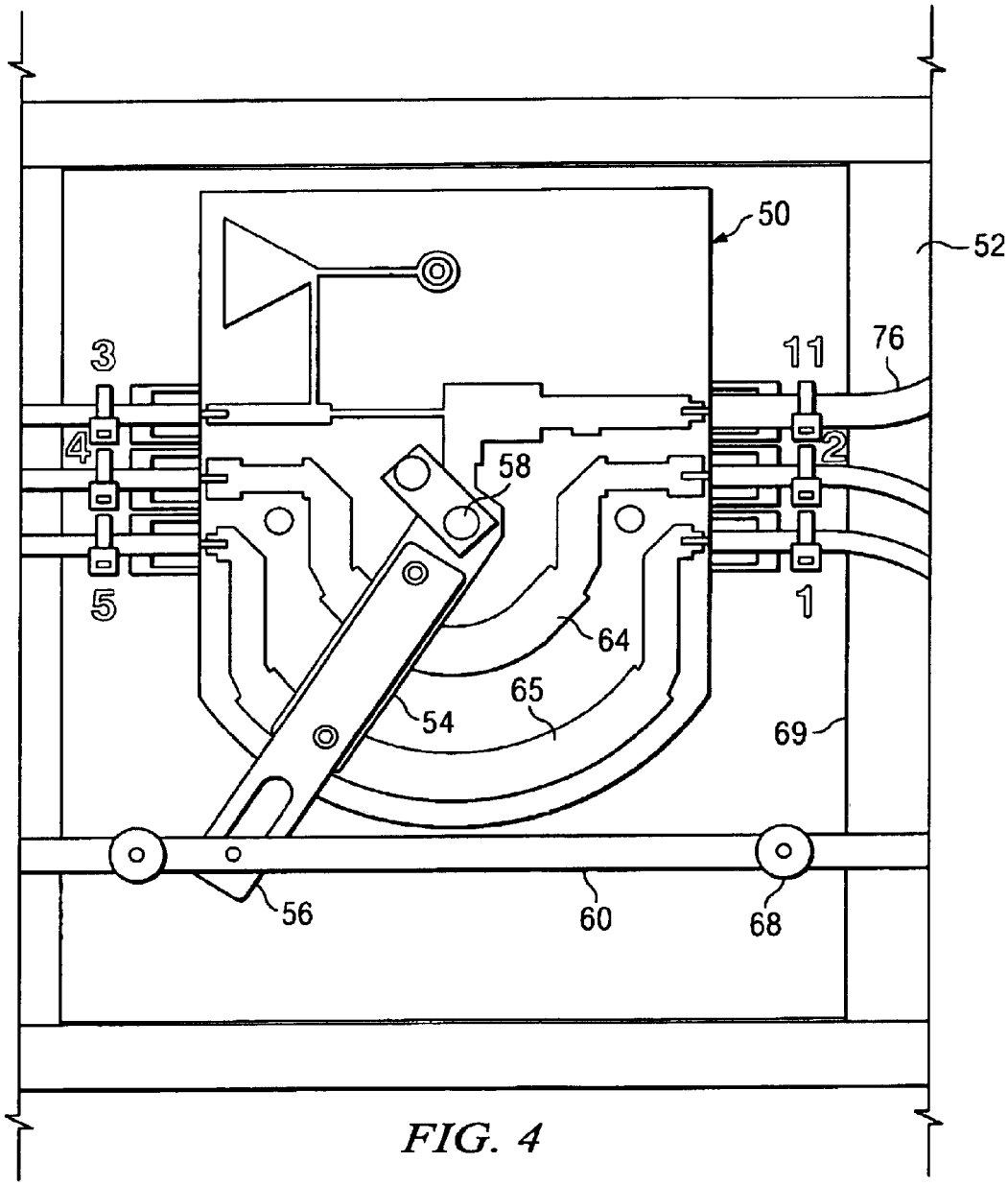
FIG. 4 is a backside view of one element tray illustrating the microstrip phase shifter design employed to feed each pair of radiating elements.

Referring now to FIG. 4 there is shown one low loss printed circuit board (PCB) 50 having disposed thereon a microstrip phase shifter system generally shown at 52. The low loss PCB 50 is secured to the backside of the respective element tray 12. Microstrip phase shifter system 52 is coupled to and feeds the opposing respective pair of radiating elements 12 via the respective divider 32, which is electrically connected to microstripline 52 accordingly the number that printed on 69 phase shifter tray.

As shown in FIG. 4, microstrip phase shifter system 52 comprises a phase shifter 54 handle having secured thereunder a dielectric member 56 which is arcuately adjustable about a pivot point 58 by a respective shifter rod 60. Shifter rod 60 is longitudinally adjustable by a remote handle (not shown) so as to selectively position the phase shifter 54 and the respective dielectric 56 across a pair of arcuate feedline portions 64 and 65 to adjust the phase velocity conducting therethrough. Shifter rod 60 is secured to, but spaced above, PCB 50 by a pair of non-conductive standoffs 68. A low loss coaxial cable is employed as the main transmission media between element trays 12, and is generally shown at 70. Each feed network 52 is functionally provide electrically connection between feed network 52 with one polarzised of the antenna 10.

Gain performance is optimized by closely controlling the phase and amplitude distribution across the array 10. The very stable phase shifter design shown in FIG. 4 achieves this control.

Referring now to FIG. 5, there is generally shown at 80 the high roll-off radiation pattern achieved by antenna 10 according to the present invention, as compared to a typical dipole radiation pattern shown at 82. This high roll-off radiation pattern 80 is a significant improvement over a typical dipole radiation pattern, and meets all of the objectives set forth in the background section of this application.

Figure 6:
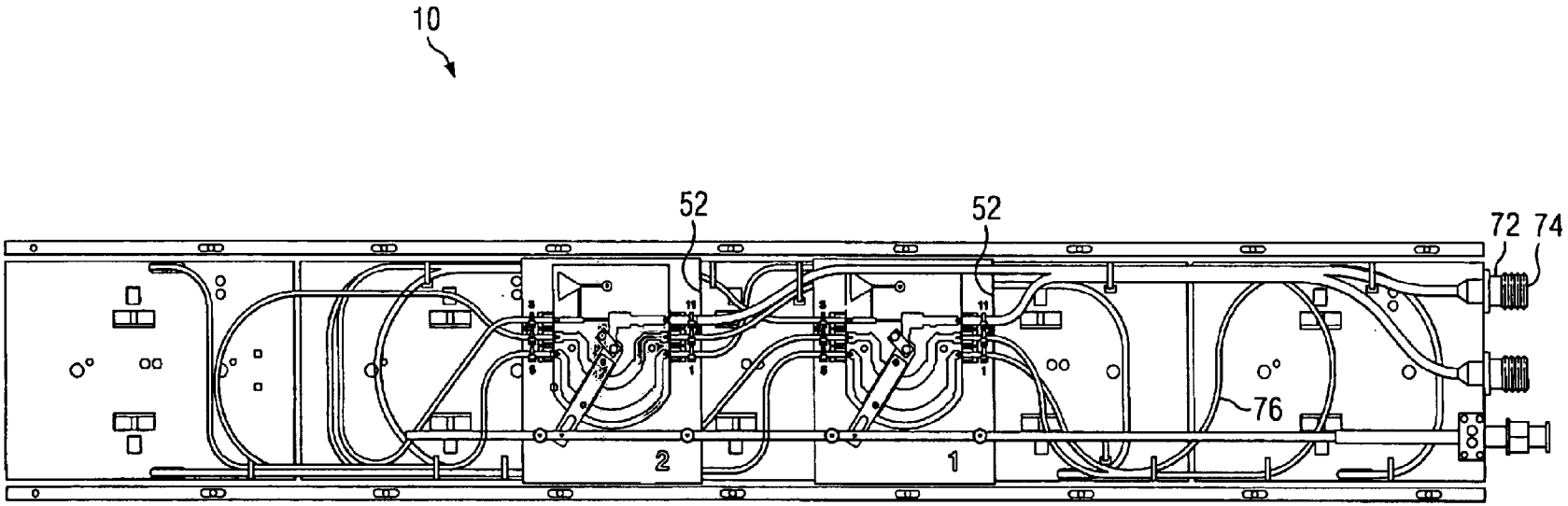
FIG. 6 is a backside view of the dual polarized antenna illustrating the cable feed network, each microstrip phase shifter feeding one of the other polarized antennas.

Referring now to FIG. 6, there is shown the backside of the antenna 10 illustrating the cable feed network, each microstrip phase shifter 52 feeding one of the other polarized antennas 12. Input 72 is referred as port I and is the input for the −45° slant (polarized), and input 74 is port II input for the +45° slont (polarized), and cable 76 is the feed network cable coupled to one phase shifter 50, as shown in FIG. 4. referring to FIG. 4, the outputs of phase shifter 50, depicted as 1–5, are shown and indicate the other antenna 12 that is feed by phase shifter 52.

Figure 7:
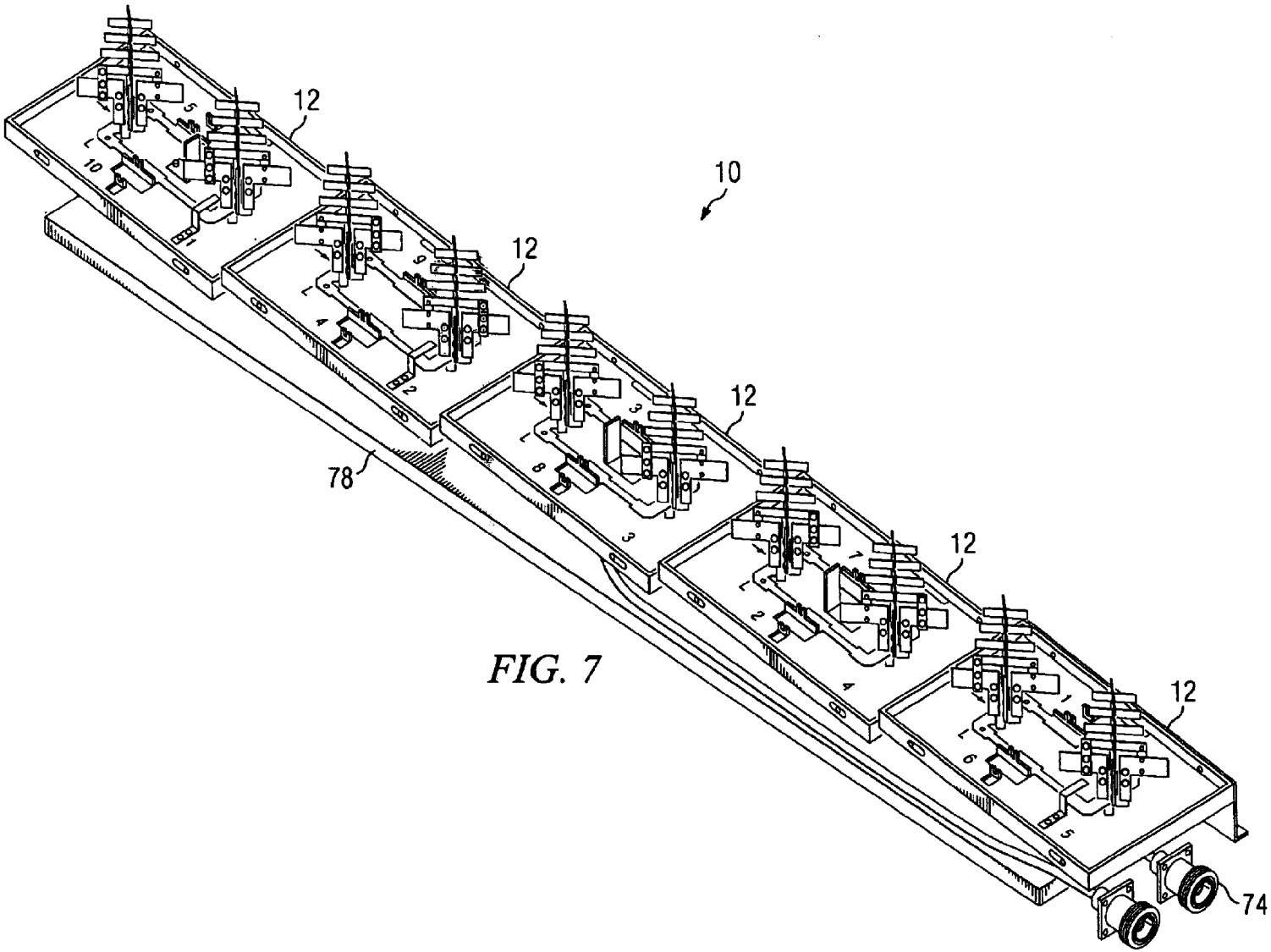
FIG. 7 is a perspective view of the dual polarized antenna including an RF absorber functioning to dissipate any RF radiation from the phase shifter microstriplines, and preventing the RF current coupling to each other's phase shifter.

Referring now to FIG. 7, there is shown antenna 10 further including an RF absorber 78 that functions to dissipate any RF radiation from the phase shifter microstrip lines, and preventing the RF current from coupling to each others phase shifter.

Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

We claim:

1. An antenna, comprising:

a plurality of groundplanes configured in a staircase arrangement; and an array of dipole antenna elements, wherein at least two of the antenna elements are disposed on each of the groundplanes, wherein the antenna elements are also configured in a staircase arrangement such that the antenna elements define a boresight downtilt.

2. The antenna as specified in claim 1 further comprising a feed network coupled to the array of antenna elements and adapted to selectively adjust a beam downtilt of the antenna.

3. The antenna as specified in claim 2 further comprising support members supporting the groundplanes in the staircase arrangement.

4. The antenna as specified in claim 3 further comprising a tray receiving the support members and groundplanes, the tray having a side wall spaced from the support members to define a gap therebetween.

5. The antenna as specified in claim 4 wherein the gap is configured to reduce RF current flowing in a backside of the tray.

6. The antenna as specified in claim 4 wherein a height of the tray sidewalls are configured to increase a front-to-back ratio of a radiation pattern of the antenna.

7. The antenna as specified in claim 1 wherein a front-to-back ratio of the antenna is at least 40 dB.

8. The antenna as specified in claim 1 wherein the dipoles have parasitic structure coupled thereto such that the antenna has a front-to-side ratio of at least 20 dB.

9. The antenna as specified in claim 1 wherein the antenna has a horizontal beam width of between about 59° to 72°.

10. The antenna as specified in claim 2 wherein the feed network comprises an air dielectric feed network disposed over at least one of the groundplanes.

11. The antenna as specified in claim 10 wherein the feed network further comprises a stripline feed network disposed on a backside of at least one of the groundplanes.

12. The antenna as specified in claim 11 wherein the feed network has a dielectric member adjustably disposed over a portion of the microstripline feed network.

13. The antenna as specified in claim 12 wherein the dielectric member is arcuately adjustable over the microstripline feed network.

14. The antenna as specified in claim 13 further comprising a shifter rod coupled to the dielectric member, such that selective positioning of the dielectric member adjusts a phase velocity of RF signals communicated through the stripline feed network.

15. The antenna as specified in claim 2 wherein the downtilt of the antenna element boresights is defined at a midpoint of an overall downtilt of the antenna.

16. The antenna as specified in claim 1 wherein the groundplanes are staggered a fixed distance from one another.

17. The antenna as specified in claim 1 wherein the dipole antennas are grouped in pairs, wherein at least one pair of dipoles is defined on each of the groundplanes.

18. The antenna as specified in claim 17 further comprising a divider coupled to each pair of the dipole pairs.

19. The antenna as specified in claim 18 wherein each divider has a beak extending through the respective groundplane and is coupled to the feed network disposed under the respective groundplane.

20. The antenna as specified in claim 19 wherein the feed network comprises an air dielectric feedline extending above the groundplane and a stripline below the groundplane.

21. The antenna as specified in claim 1 wherein the dipole elements are Yagi dipoles.

22. The antenna as specified in claim 11 further comprising an RF absorber coupled closely proximate the stripline feed network and being adapted to reduce RF current coupling between stripline portions.

* * * * *